US009995042B2

(12) United States Patent
Axford

(10) Patent No.: US 9,995,042 B2
(45) Date of Patent: Jun. 12, 2018

(54) COVERS FOR GUTTERING

(71) Applicant: ACAMBA PTY LTD, Rouse Hill (AU)

(72) Inventor: Paul Phillip Axford, Baulkham Hills (AU)

(73) Assignee: ACAMBA PTY LTD, Rouse Hill (AU)

( * ) Notice: Subject to any disclaimer, the term of this patent is extended or adjusted under 35 U.S.C. 154(b) by 0 days. days.

(21) Appl. No.: 15/519,598

(22) PCT Filed: Oct. 19, 2015

(86) PCT No.: PCT/AU2015/050644
§ 371 (c)(1),
(2) Date: Apr. 17, 2017

(87) PCT Pub. No.: WO2016/058059
PCT Pub. Date: Apr. 21, 2016

(65) Prior Publication Data

US 2017/0254088 A1 Sep. 7, 2017

(30) Foreign Application Priority Data

Oct. 17, 2014 (AU) ..... 2014904157

(51) Int. Cl.
*E04D 13/076* (2006.01)
*E04D 13/072* (2006.01)
*E04D 13/068* (2006.01)
*E04D 13/04* (2006.01)

(52) U.S. Cl.
CPC ..... *E04D 13/076* (2013.01); *E04D 13/068* (2013.01); *E04D 13/0725* (2013.01);
(Continued)

(58) Field of Classification Search
None
See application file for complete search history.

(56) References Cited

U.S. PATENT DOCUMENTS 2,672,832 A 3/1954 Goetz et al.
3,592,721 A * 7/1971 Formanek ..... E04D 13/064 428/121

(Continued)

FOREIGN PATENT DOCUMENTS

WO 9619624 6/1996

OTHER PUBLICATIONS

International Patent Application No. PCT/AU2015/050644, International Search Report and Written Opinion, dated Nov. 26, 2015, 10 pages.

*Primary Examiner* — Jeanette E Chapman
(74) *Attorney, Agent, or Firm* — Kilpatrick Townsend & Stockton LLP; Dean W. Russell

(57) ABSTRACT

An assembly for covering a gutter is disclosed which comprises a mounting member for attachment to a fascia or rafter or the like (10; 100) and a cover member (50) for covering and enclosing a gutter. The mounting member provides upper (22; 120) and lower (34;117) engagement means for engagement with corresponding engagement means (58, 62) defined in ends of the cover member. The engagement means of the mounting member include at least one gap or a space defined between two spaced walls for receiving a generally v-shaped end of the cover and at least one of the walls defines a flange/stop for engaging with the end of the cover for retaining the end of the cover between the walls. The cover will typically be formed from a material such as rolled steel, which may be coated painted or otherwise treated so as to be rust-resistant. The engagement means for the cover will typically be a generally v-shaped bend in one end of the over which engages in the slot by compression of the sides of the "v" together then expansion to engage in the gap/space. The bracket (10) may be generally planar and attach to a fascia board of a roof defining apertures for receiving fasteners in its front face for attach- (Continued)

ment to the fascia board. Alternatively the bracket (110) may define an attachment plate oriented at an angle of about 90° to the front face of the bracket for attachment directly to rafter, thus obviating the need for a fascia board.

3 Claims, 4 Drawing Sheets

(52) U.S. Cl.
CPC ..... *E04D 13/0727* (2013.01); *E04D 13/0685* (2013.01); *E04D 2013/0427* (2013.01)

(56) References Cited

U.S. PATENT DOCUMENTS 4,455,791 A 6/1984 Elko et al.
5,305,562 A * 4/1994 Sapia ..... E04D 13/076 52/11
5,557,891 A * 9/1996 Albracht ..... E04D 13/076 52/11
5,724,776 A * 3/1998 Meadows, Jr. ..... E04D 13/15 52/11
5,862,631 A * 1/1999 Attaway ..... E04D 13/0722 52/11
5,884,876 A * 3/1999 Axford ..... E04D 13/0722 248/48.1
6,314,685 B1 * 11/2001 Sullivan ..... E04D 13/064 52/11
6,931,792 B2 * 8/2005 McDonald ..... E04D 13/064 52/11
7,117,643 B2 * 10/2006 Brown ..... E04D 13/064 248/48.2
7,347,027 B2 * 3/2008 McDonald ..... E04D 13/0481 248/48.1
8,683,748 B2 * 4/2014 Arch ..... E04D 13/00 52/27

* cited by examiner 100
104
102

100
120
118
114
109
100

108
116
117
110
102
114
104
110
118
108
116

114
110
100
102
112

COVERS FOR GUTTERING

CROSS-REFERENCE TO RELATED APPLICATIONS

The present application claims priority from Australian Provisional Patent Application No 2014904157 filed on 17 Oct. 2014, the content of which is incorporated herein by reference.

TECHNICAL FIELD

This invention relates to covers for guttering, and to brackets for mounting guttering covers.

Brackets for supporting roof gutters are typically generally U-shaped, having an upright section for attachment to a fascia, and a gutter support arm for engagement with the roof gutter. When such brackets are mounted on a fascia, the supporting arm of each fascia bracket must be spaced relative to the supporting arm of the other gutter brackets to provide sufficient gutter support. Each support arm must also be positioned such that the gutters are supported in an inclined longitudinal orientation to allow for water to drain under gravity. Positioning a number of brackets along a fascia to provide support and sufficient drainage inclination can be time consuming. Often gutters are badly installed, the inclination is insufficient, and pooling occurs in the gutters.

A second problem which occurs with gutters is a build-up of leaves, twigs, nuts, fruits and other debris from trees in the gutter. In order to address this problem, it is known to cover the open top of the gutter with a mesh or similar covering which has holes of a size intended to permit the ingress of water but prevent the ingress of leaves into the gutter. Such systems can be unsightly, and are often fiddly and difficult to install.

Australian Patent No. 689012, the entire contents of which are incorporated herein by reference, describes a bracket assembly which addresses some of the above problems by providing an adjustable gutter bracket which includes a mounting member which can be mounted to a fascia and a generally U-shaped support member 14 which is releasably attachable to the mounting member. The attachment is by rotation of the support member relative to the mounting member such that lugs on the support member engage an elongate aperture in the mounting member which defines a series of triangular shaped notches. A cover attachment is provided for attachment to the support member which can be used to mount a concealed covering.

While the system is significant improvement over past systems, it has the disadvantage that it is quite a complicated process to install the system, particularly where a cover is used which is partially installed underneath the lowest line of tiles on the roof.

An improvement to the system shown in Australian Patent No. 689012 is described and shown in Australian Innovation Patent No 2012101760 which attaches a cover over the guttering system using brackets and clips. The present application relates to further improvements to the guttering bracket assembly shown in AU 2012101760, and which also advantageously in some applications, e.g. new housing, can obviate the need for installing a fascia board.

Any discussion of documents, acts, materials, devices, articles or the like which has been included in the present specification is not to be taken as an admission that any or all of these matters form part of the prior art base or were common general knowledge in the field relevant to the present disclosure as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

According to the present there is provided an assembly for covering a gutter comprising:

a mounting member for attachment to a fascia or rafter or the like, a cover member for covering and enclosing a gutter, said mounting member providing upper and lower engagement means for engagement with corresponding engagement means defined in ends of the cover member; wherein the engagement means of the mounting member include at least one gap or a space defined between two spaced walls for receiving a generally v-shaped end of the cover and wherein at least one of the walls defines a flange/stop for engaging with the end of the cover for retaining the end of the cover between the walls.

The cover will typically be formed from a material such as rolled steel, which may be coated painted or otherwise treated so as to be rust-resistant. The engagement means for the cover will typically be a generally v-shaped bend in one end of the over which engages in the slot by compression of the sides of the "v" together then expansion to engage in the gap/space.

The gap/space may be a slot defined between two generally parallel opposed walls. Alternatively the walls may be axially staggered and not opposed.

At the lower end of the cover may either define a hook which engages to the rear face of the bracket or a further v-shaped portion which engages in another gap in the bracket.

The bracket may be generally planar and attach to a fascia board of a roof defining apertures for receiving fasteners in its front face for attachment to the fascia board.

Alternatively the bracket may define an attachment plate oriented at an angle of about 90° to the front face of the bracket for attachment directly to rafter.

Attachment of the bracket directly to the rafter has the advantage that a fascia board is not required, saving time and money. Brackets for mounting guttering may be attached directly to the rafters. Gutters are then mounted and adjusted, typically using the adjustable gutter mounting system described in Australian Patent No. 689012. The Cover is them attached and this covers the gutters and the ends of the rafters.

In one embodiment, the lower engagement means is a further slot at the base of the bracket for receiving a v-shaped engagement means.

Alternatively, the lower engagement means may hook behind the bracket.

BRIEF DESCRIPTION OF DRAWINGS

A specific embodiment of the present invention will now be described by way of example only and with reference to the accompanying drawings in which.

DESCRIPTION OF EMBODIMENTS

Figure 2:
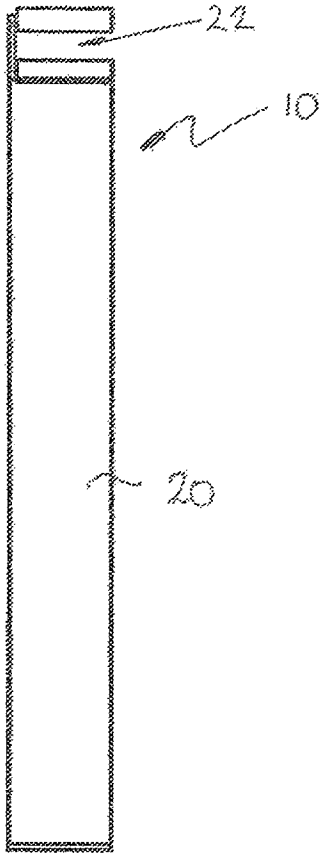
FIG. 2 is a side view of the bracket of FIG. 1.
Figure 1:
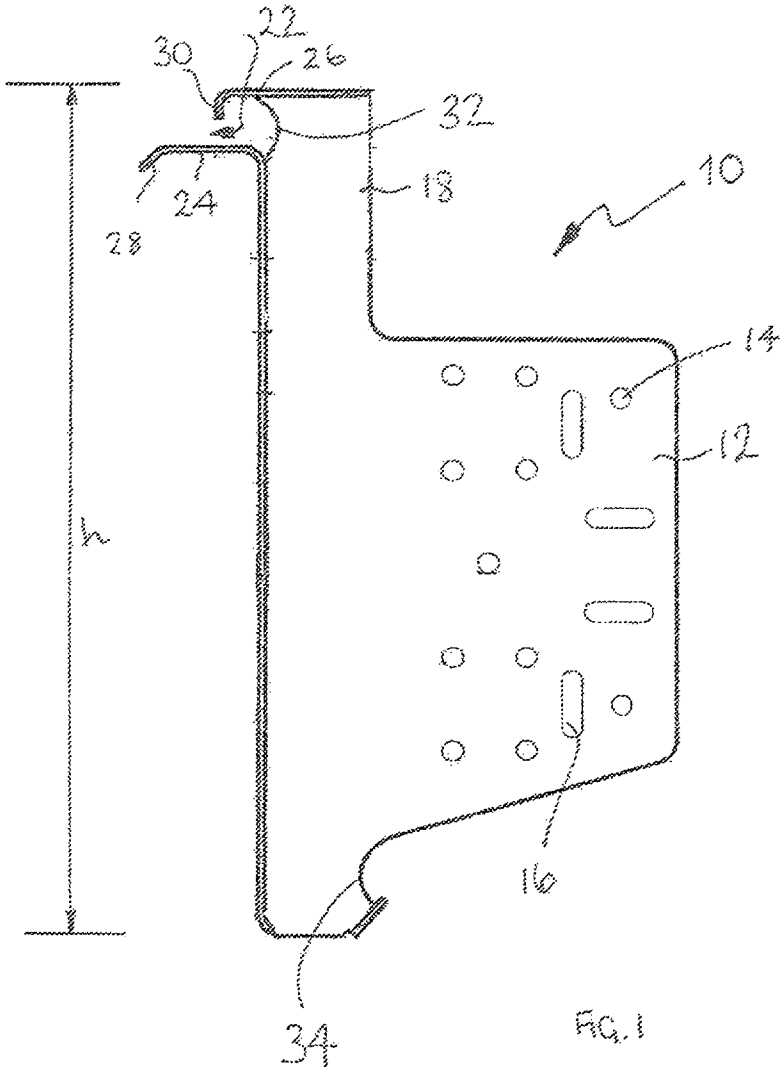
FIG. 1 is a front view of a bracket for use in attaching a gutter cover to a rafter.

Referring to the drawings, FIGS. 1 and 2 show a first bracket 10 for attaching a gutter cover to the side of a rafter. The bracket includes a first perforated planar portion 12 which is in the shape of a right angled trapezium and defines an array of circular holes 14 and elongate through apertures 16 which can be used to fix the bracket to the side of a rafter (not shown) using fasteners. The bracket is typically formed from sheet metal such as steel, which may be stainless or coated or painted for resistance to rusting.

A further side portion 18 which is co-planar with the first portion extends along one side of the perforated portion, being loner than the perforated portion and extending to either side of it, so that the bracket can extend above and below the rafter. While the dimensions of the bracket are not critical, and may be changed, the first portion is approximately 60 mm wide by 110 mm deep at its longest, and the side portion has a height h of approximately 180 mm so there is sufficient distance between the top and the bottom of the bracket to attach a cover having a height/depth sufficient to enclose a gutter. It is to be noted that the gutter may be mounted to the fascia by any suitable means and the means of mounting the gutter to the fascia do not form part of this invention.

Figure 5:
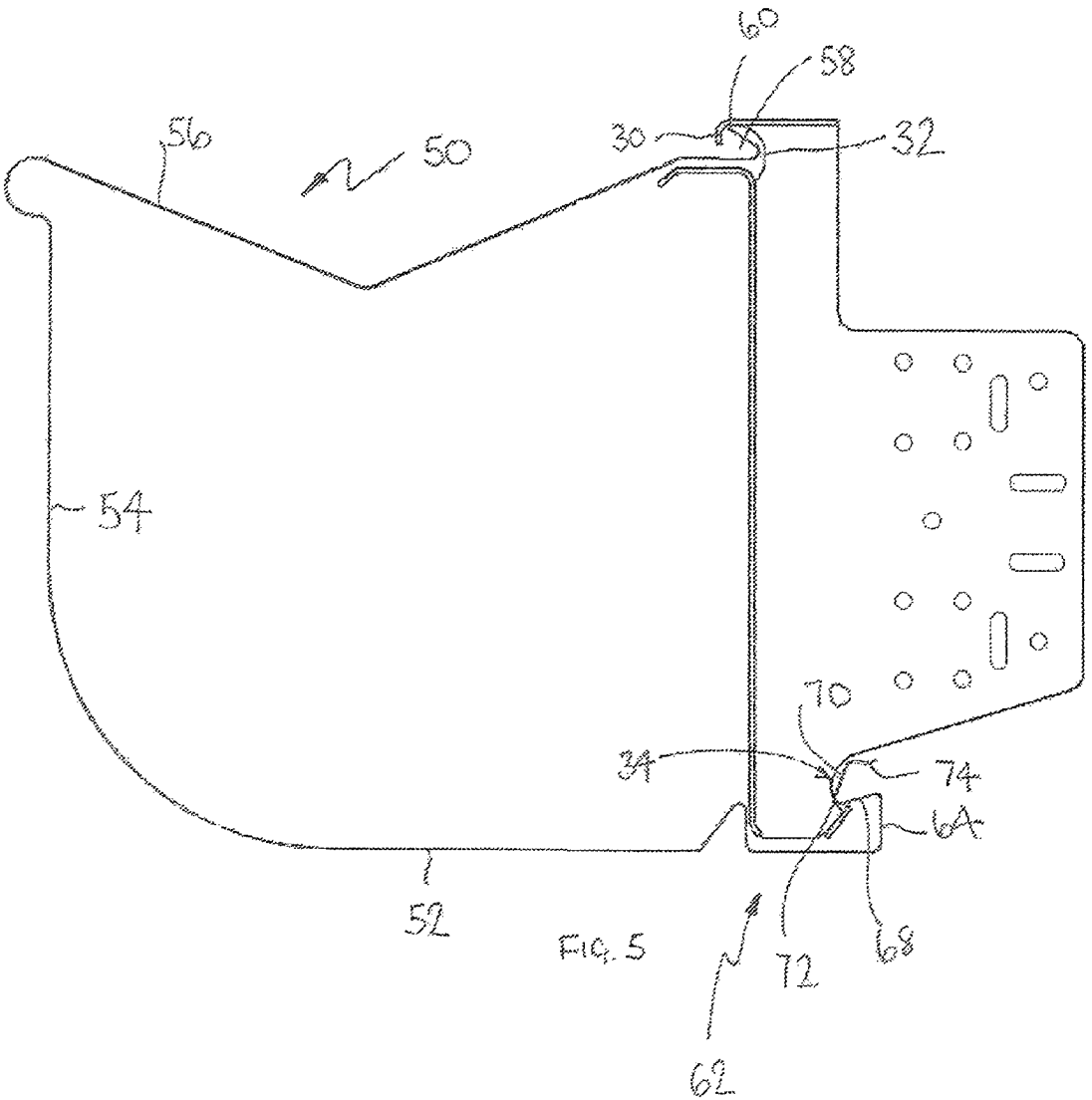
FIG. 5 illustrates the bracket of FIG. 1 engaged with a gutter cover.

At the edge of the side portion, the bracket turns though 90° to define a front face/portion 20 which, in use, faces out from the roof of the house and defines a female engagement means 22 including a slot for receiving a free end of a cover 50, shown in more detail in FIG. 5. The cover (refer to FIG. 5) defines three sides including a generally planar base 52, a front wall 54 which curves up from the base towards a top wall 56 which is generally v-shaped and defines a series of holes covered in perforated pyramidal structures (not shown) which allow water to pass through the holes but prevent the passage of leaves and other detritus.

In more detail, the female engagement means 22 comprises a slot defined between a lower planar wall portion 24 and a parallel upper planar wall portion 26. The front or proximal end of the lower planar portion is bent downwards at 28, to help guide the free end of the cover into the slot. The proximal end 30 of the upper planar portion is turned downwards through 90° to define a stop/flange so that the entrance to the slot is narrower than the space behind which receives the end of the cover. A curved stop 32 is located behind the slot 22.

As best seen in FIG. 5, the free end of the cover is bent to define a v-shaped end portion 58 which functions as the male engagement means for engaging in the slot. Being made of a flexible sheet metal the sides of the v flex towards each other as they pass through the slot 22, then flex apart after passing through the slot locking the engagement means to the bracket, with the end 60 of the portion 58 held behind the proximal end 30 of the upper portion. The curved stop 32 limits the movement of the end 58 beyond the slot.

With reference to FIGS. 1 and 5, the lower end of the bracket defines a curved or c-shaped recess 34 where the perforated portion 12 meets the side portion 18.

The lower end of the cover 62 defines a hook which engages behind the bracket 10 for securing the lower end of the cover to the bracket as shown in FIG. 5. In more detail, the lower free end 62 defines a channel 64 which locates under bottom of the bracket and a generally V-shaped hook which engages in the c-shaped recess. The hook defines two opposed portions 68 and 70 which meet at an apex 72 which engages the recess 34, and a curved end flange 74.

In use, the brackets 10 are attached to the ends of the rafters of the roof. Note that no fascia board needs to be fitted to the ends of the rafters, saving time and money. Brackets (not shown) for mounting guttering are attached directly to the rafters. Gutters are then mounted and adjusted, typically using the adjustable gutter mounting system described in Australian Patent No. 689012. The cover 50 is then attached either by hooking the hook portion of the cover behind the and pushing the male engagement means in the slot 22, or by inserting the male engagement means in the slot 22 and subsequently attaching the hook 62.

The cover can be removed or part removed for cleaning if necessary, although it is envisaged that cleaning of the gutters will only rarely be necessary, if at all.

The front face 20 of the bracket may also define means for attaching a gutter, at a range of different heights.

Figures 3, 4, 4A:
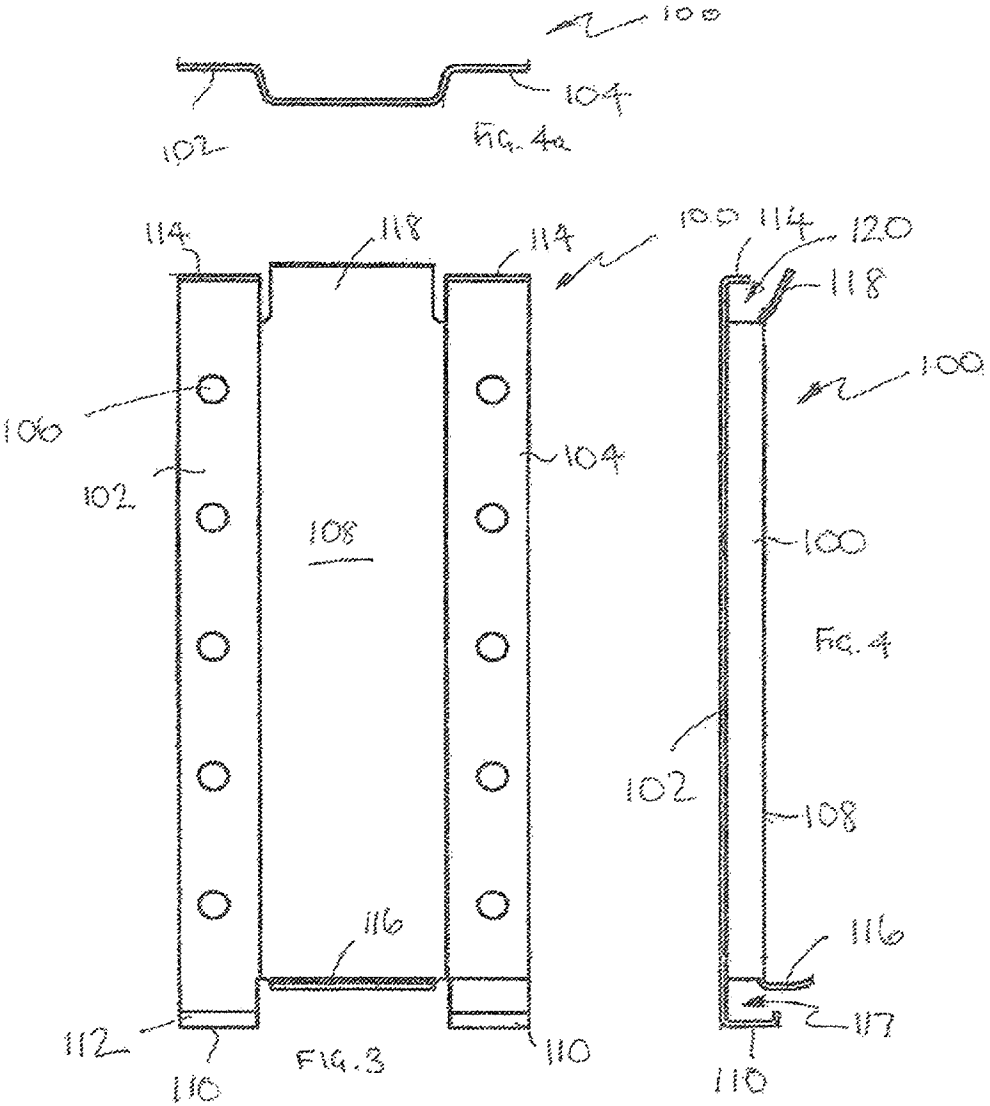
FIG. 3 is a front view of an alternative bracket for use in attaching a gutter cover to a fascia board.
FIG. 4 is a side view of the bracket of FIG. 3.
FIG. 4*a* is a cross-sectional view of the bracket of FIG. 3.
Figure 6:
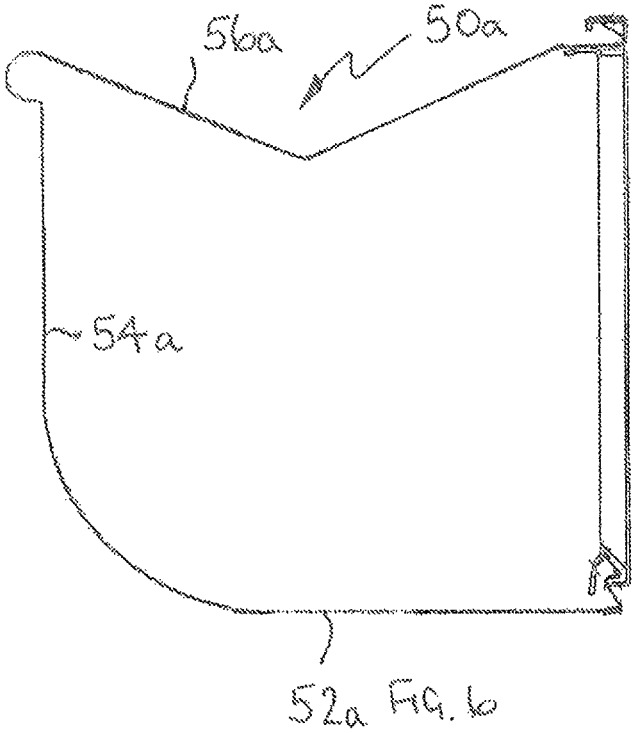
FIG. 6 illustrates the bracket of FIG. 3 engaged with a gutter cover.

FIGS. 3, 4 and 6 illustrate a second, alternative embodiment of a mounting bracket 100 for use in existing properties which already include a fascia board. In this embodiment the bracket is generally planar in the shape of a flattened top hat in cross-section (see FIG. 4*a*) and attaches to the front of the fascia board. The bracket defines two side portions 102, 104, which define series of holes 106 for attaching the bracket to the fascia, and a central portion 108.

As is best seen in FIG. 4, the lower end of the side portion 102 is bent through 90° to define a short wall portion 110 jutting out perpendicularly from the bracket which has a short upturned flange 112 at its end. The lower end of the side portion 104 is the same. The upper end of the side portion 102 is bent through 90° to define a further short wall portion 114 jutting out perpendicularly from the bracket.

The lower end of the central portion 108 is also bent through 90° to define a yet further short wall portion 116 jutting out perpendicularly from the bracket. As is best seen in FIG. 4, the wall portion 116 is parallel to and spaced from the wall portion 110 and defines a gap 117 when viewed from the side.

At the upper end, a top portion 118 of the central portion 108 is bent to an angle of about 30-40° to the plane of the bracket. Again, as is best seen in FIG. 4, the top portions 118 of the central portion 108 and the further short wall portion 114 are spaced from one another and define a gap 120 between 4-20-them when viewed from the side.

FIG. 6 illustrates the engagement of a cover 50*a* in the bracket. The overall size and shape of the cover 50*a* is the same as cover 50, the only difference being the engagement means at the lower end of the cover, with the engagement means at the upper end of the cover being the same as that of cover 50. In particular, the lower end of the cover is bent/shaped to form a zig-zag shape which general conforms to the gap defined between the portions 118 and 114. In particular, the distal end of the cover defines a V-shaped portion that engages in the gap as shown in FIG. 6. Note that in the case of the fascia bracket, the walls are axially staggered and not opposed/facing one another.

In use a series of brackets 100 are mounted to the fascia board. The brackets may also include means for adjustably mounting a gutter such as is shown in AU 2012101760, or the guttering may be mounted separately. The ends of the cover being made of a resilient flexible material, flex when fitting into the gaps between the walls in the front of the bracket.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. An assembly for enclosing a gutter mounted to a fascia, comprising:

a mounting member configured for attachment to the fascia, and a cover member configured for attachment to the mounting member for covering and enclosing the gutter, said mounting member providing upper engagement means and lower engagement means configured for engagement with corresponding upper and lower engagement means defined in ends of the cover member; wherein the upper engagement means of the cover member comprises a generally v-shaped end, wherein the upper engagement means of the mounting member includes at least one aperture in the form of a gap or a space defined between two spaced walls for receiving the generally v-shaped end of the cover, and wherein at least one of the walls defines a flange or stop for engaging with the generally v-shaped end of the cover member for retaining the generally v-shaped end of the cover member between the walls;

wherein the mounting member has a generally planar rear wall configured for attachment to the fascia, and the at least one aperture is defined in a front face of the mounting member; and wherein the lower engagement means of the mounting member includes at least one slot defined in the front face of the mounting member for receiving a v-shaped engagement means forming the lower engagement means of the cover member.

2. An assembly as claimed in claim 1 wherein the upper engagement means of the cover member engages in the at least one aperture by compression of sides of the "v" together, which sides then expand to engage in the gap or space.

3. An assembly as claimed in claim 1 wherein the front face of the mounting member defines means for mounting the gutter at a range of different heights.

* * * * *